US009175925B2

(12) United States Patent
Pellegrini

(10) Patent No.: US 9,175,925 B2
(45) Date of Patent: Nov. 3, 2015

(54) HANDGUN HOLSTER PROVIDED WITH A SHUTTER SAFETY LOCK

(75) Inventor: Paolo Pellegrini, Fucecchio (IT)

(73) Assignee: RADAR LEATHER DIVISION, S.R.L., Fucecchio (Firenze) (IT)

( * ) Notice: Subject to any disclaimer, the term of this patent is extended or adjusted under 35 U.S.C. 154(b) by 11 days.

(21) Appl. No.: 14/113,141

(22) PCT Filed: May 9, 2012

(86) PCT No.: PCT/IB2012/052305

§ 371 (c)(1),
(2), (4) Date: Nov. 4, 2013

(87) PCT Pub. No.: WO2012/153278

PCT Pub. Date: Nov. 15, 2012

(65) Prior Publication Data

US 2014/0048573 A1 Feb. 20, 2014

(30) Foreign Application Priority Data

May 10, 2011 (IT) ..... FI2011A0098

(51) Int. Cl.
*F41C 3/02* (2006.01)
*F41C 33/02* (2006.01)

(52) U.S. Cl.
CPC ..... *F41C 33/0263* (2013.01); *F41C 33/0227* (2013.01)

(58) Field of Classification Search
CPC ..... F41C 33/0218; F41C 33/0277; F41C 33/0263
USPC ..... 224/192–193, 198, 243, 238, 912
See application file for complete search history.

(56) References Cited

U.S. PATENT DOCUMENTS

| | | | | |
|---|---|---|---|---|
| 2004/0050887 | A1* | 3/2004 | Spielberger | 224/244 |
| 2005/0035162 | A1* | 2/2005 | Lowe et al. | 224/243 |
| 2005/0035163 | A1 | 2/2005 | French et al. | |
| 2007/0181619 | A1 | 8/2007 | Seyfert et al. | |
| 2009/0294496 | A1* | 12/2009 | Gallagher | 224/243 |
| 2009/0321480 | A1* | 12/2009 | Kincaid et al. | 224/243 |
| 2010/0176165 | A1* | 7/2010 | Lowe et al. | 224/191 |
| 2011/0101063 | A1* | 5/2011 | Zusman | 224/682 |

FOREIGN PATENT DOCUMENTS

WO WO 2009/095938 A1 8/2009

OTHER PUBLICATIONS

International Search Report of PCT/IB2012/052305 dated Aug. 20, 2012.

* cited by examiner

*Primary Examiner* — Justin Larson
*Assistant Examiner* — Phillip Schmidt
(74) *Attorney, Agent, or Firm* — Lucas & Mercanti, LLP

(57) ABSTRACT

The present invention refers to an improved holster for handguns, adapted to prevent the accidental drop or an unauthorized extraction of the handgun, thanks to a safety device embodied in the same holster and comprising a shutter lock.

14 Claims, 5 Drawing Sheets

HANDGUN HOLSTER PROVIDED WITH A SHUTTER SAFETY LOCK

CROSS-REFERENCE TO RELATED APPLICATIONS

This application is a 371 of PCT/IB2012/052305, filed May 9, 2012, which claims the benefit of Italian Patent Application No. FI2011A000098, filed May 10, 2011, the contents of each of which are incorporated herein by reference.

FIELD OF THE INVENTION

The present invention refers to the field of safety devices for guns and, more precisely, to an improved holster for handguns that, thanks to a shutter safety lock, is adapted to prevent the accidental or unauthorized extraction of the gun from the same holster.

BACKGROUND OF THE INVENTION

As known, handgun holsters, in particular those in use by police officers and surveillance staff for defending people and goods, must be designed so as to hold the gun firmly, not only during the normal movements of the user but also when more intense physical efforts, or fights or similar circumstances occur, ensuring nonetheless an easy and quick gun extraction by the user, when needed.

Various safety devices are provided to such purpose, locking the gun inside the holster when not in use, allowing for a somehow quick release when necessary. In fact, these safety devices, if on the one hand must effectively fasten the gun to the holster when the same gun is at rest, on the other hand they must let the gun be easily and promptly extracted as soon as the necessity arises.

Among the different known arrangements, a particularly effective one is that making use of a movable strap applied to the opening of the holster so as to encircle the gun in correspondence to the stock when the same gun is accommodated inside the holster. A snap fastening device biases the strap in this position preventing the gun from coming out of the holster. In order to extract the gun, it is sufficient to press a push-button arranged on the strap to disengage/release the snap fastening device, overcoming an elastic reaction, and make the strap angularly displace so as to set the gun free.

A further improved safety is obtained, namely to prevent the strap from being rotated accidentally or by a person different from the user wearing the holster, if the strap releasing push-button is provided with a stop that must necessarily be removed if one wishes to permit the rotation. In this way, the safety of the device is indeed improved; however, the extraction of the gun is made more troublesome since two distinct movements of the hand must in sequence be carried out. This is a possible source of difficulties and delays, that can also put the user in danger.

A solution that is substantially equivalent to the one just described is disclosed in U.S. Pat. No. 7,434,712, the strap being replaced by a movable cap.

In US2007/181619 a holster having the features in the preamble of annexed claim 1 is disclosed. 1. The holster includes a shutter that locks from above the holster opening, and a release device mounted in a side wall of the holster and comprising a displaceable member the actuation of which causes the shutter to rotate and clear the holster opening for permitting the extraction of the holster. However, the shutter is bulky and the rotation, towards the front side of the holster, is not duly safe and convenient.

It is therefore still deeply felt the need for an improved holster safety device that is suitable for any kind of handguns and has a gun locking/unlocking system that does not have the above mentioned advantages of the known devices.

SUMMARY OF THE INVENTION

The object of the present invention is to provide a safety device for handgun holsters being at least as safe as the known devices, but permitting a quicker and easier unlocking when required.

A particular object of the present invention is then to provide a holster provided with a handgun locking device arranged in correspondence to the insertion opening of the holster that is intrinsically safe and does not require further safety catches/stops conceived to hinder the accidental extraction of the gun.

These objects are achieved with the improved handgun holster according to the invention, having the essential characteristics defined by the first of the appended claims.

Further important characteristics of the present improved holster are defined by the dependent claims.

BRIEF DESCRIPTION OF THE DRAWINGS

The features and advantages of the holster according to the invention will be apparent from the following description of an embodiment thereof, which is given merely by way of a non-limiting example, with reference to the attached drawings, in which.

DETAILED DESCRIPTION OF THE INVENTION

Referring to the above figures, a holster according to the invention comprises a hollow body 1 adapted to house a gun which is inserted through an opening 1*a* of the body 1. The body 1 comprises two substantially parallel side walls 1*b*, connected frontally and at the back by a front wall 1*c* and a back wall 1*d*, respectively. At the top, the side walls 1*b* are however directly joined by a bridging shell 1*g*, slightly bulging from the front wall and comprising preferably two side slanting wall portions in a V-shaped arrangement.

Figure 1:
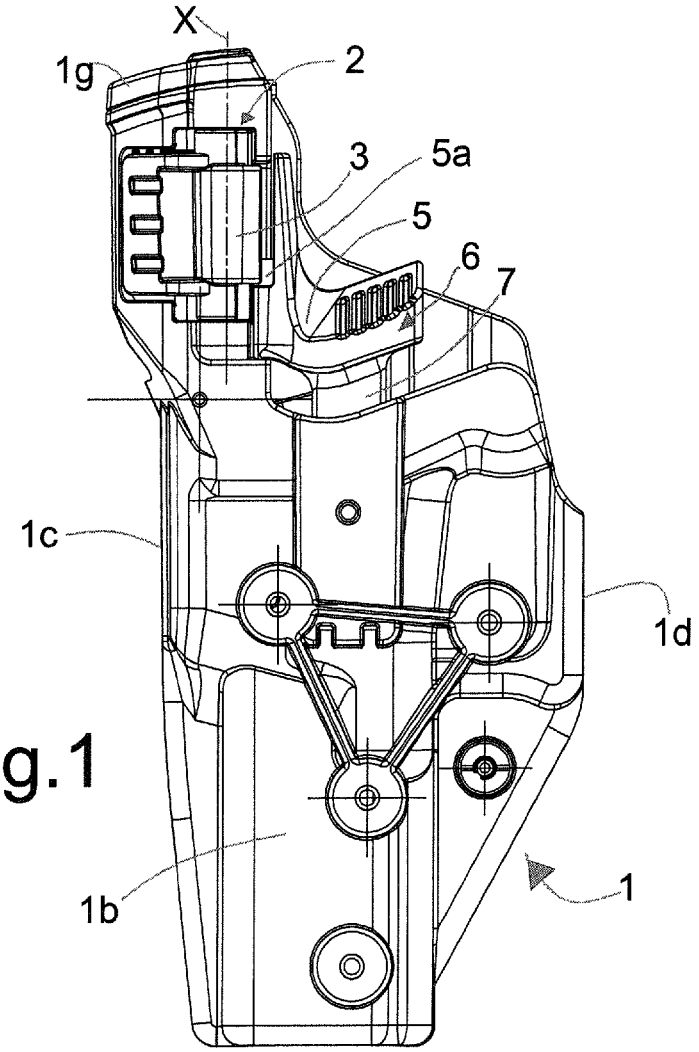
FIG. 1 is a side view of a holster according to the invention.
Figure 2:
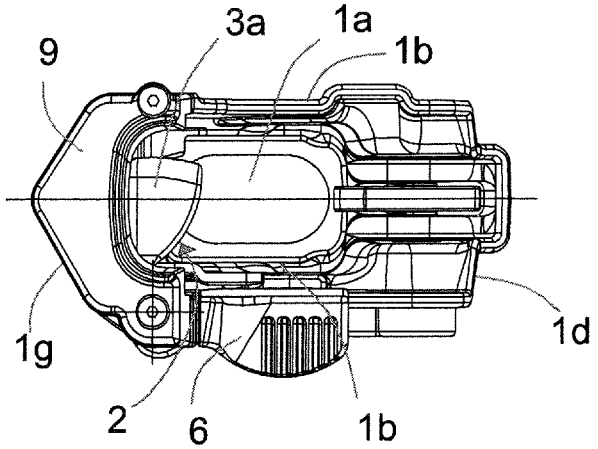
FIG. 2 is a top plan view of the holster of FIG. 1.
Figure 5:
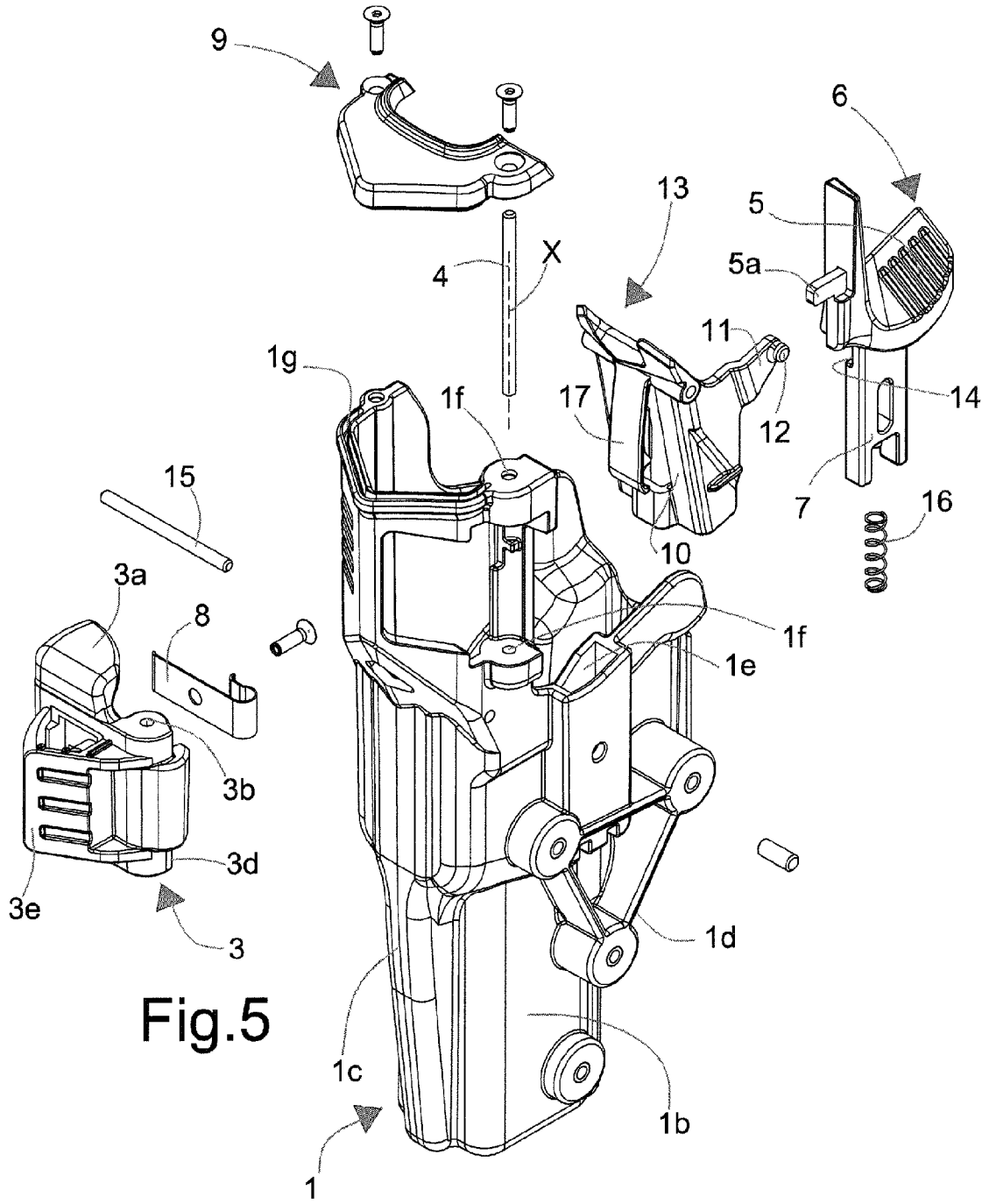
FIG. 5 is an exploded view of the holster of FIG. 4.
Figure 6:
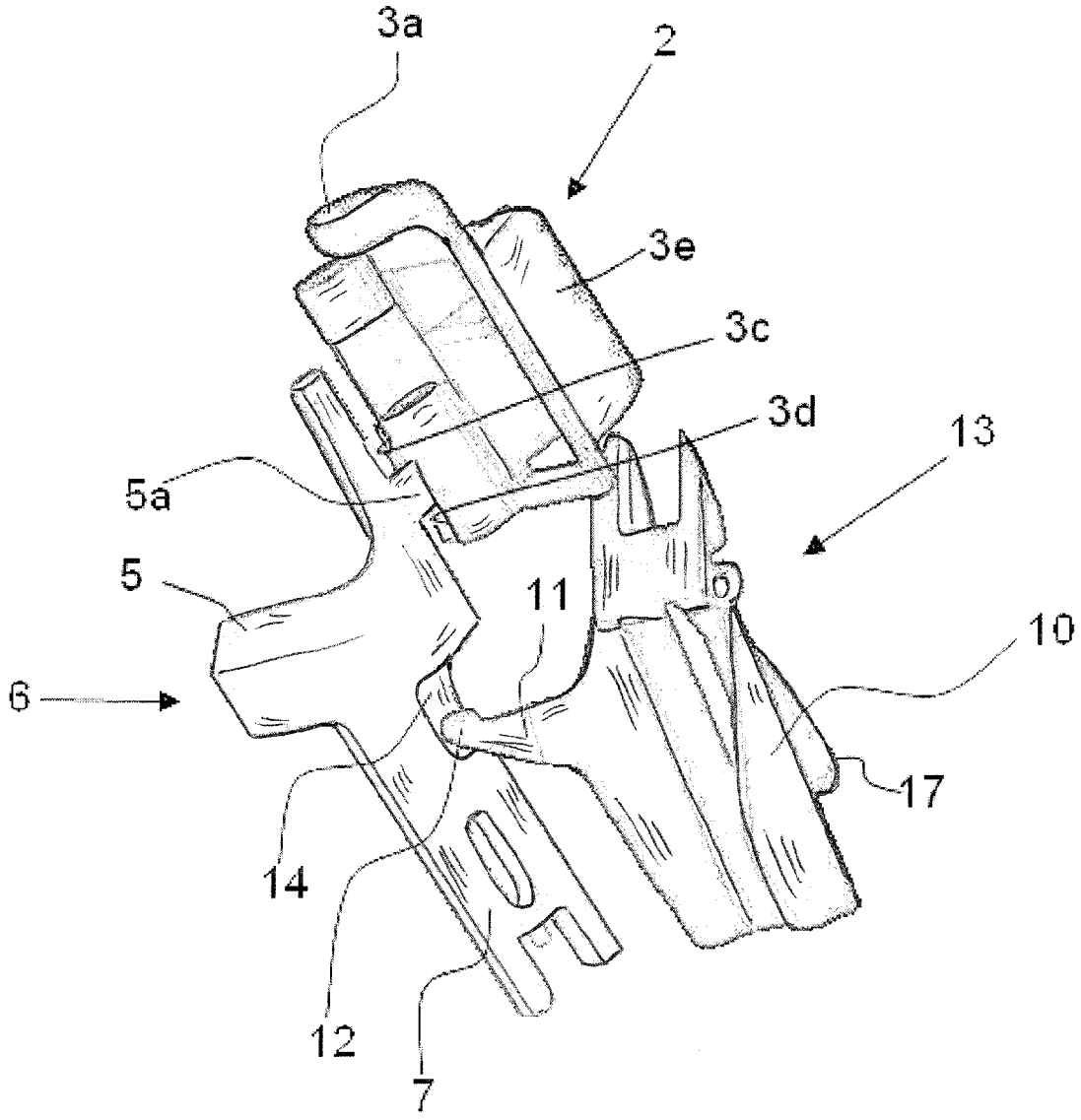
FIG. 6 is a lateral perspective view of a detail of the secondary lock of FIG. 4.

The holster further comprises a first locking device for locking the handgun against its extraction, generally indicated at 2 and comprising a shutter 3 with a top projection 3*a* that in a working position projects inside the body 1 through a window 1*h* formed in the shell 1*g* (specifically in one of its slanting wall portions), and in this way partially shuts the opening 1*a* of the body 1, preventing the handgun from being extracted, as shown in particular in FIG. 2. The shutter 3 of the locking device is integral with a pivot 4 pivotally connected to a side wall 1*b*, the pivoting axis being an axis X in the longitudinal direction of the body 1 (i.e. the direction corresponding to the axis of the barrel of the gun in its housing arrangement within the body). A seat 3*b* is formed in the shutter 3 (FIG. 5) for fixing the pivot 4, which at its ends rotatably engages with holes 1*f* of the body 1.

A catch/release device of the shutter 3 is mounted according to the invention on the same side wall 1*b* on which the locking shutter is also mounted, and comprises a movable member slidable along the holster body 1 in the longitudinal direction, such that pursuant to an actuation by user, the displacement of the movable member causes the rotation of the shutter 3 to a clearance position clearing the opening 1*a* of the holster to unlock the handgun.

Figure 3:
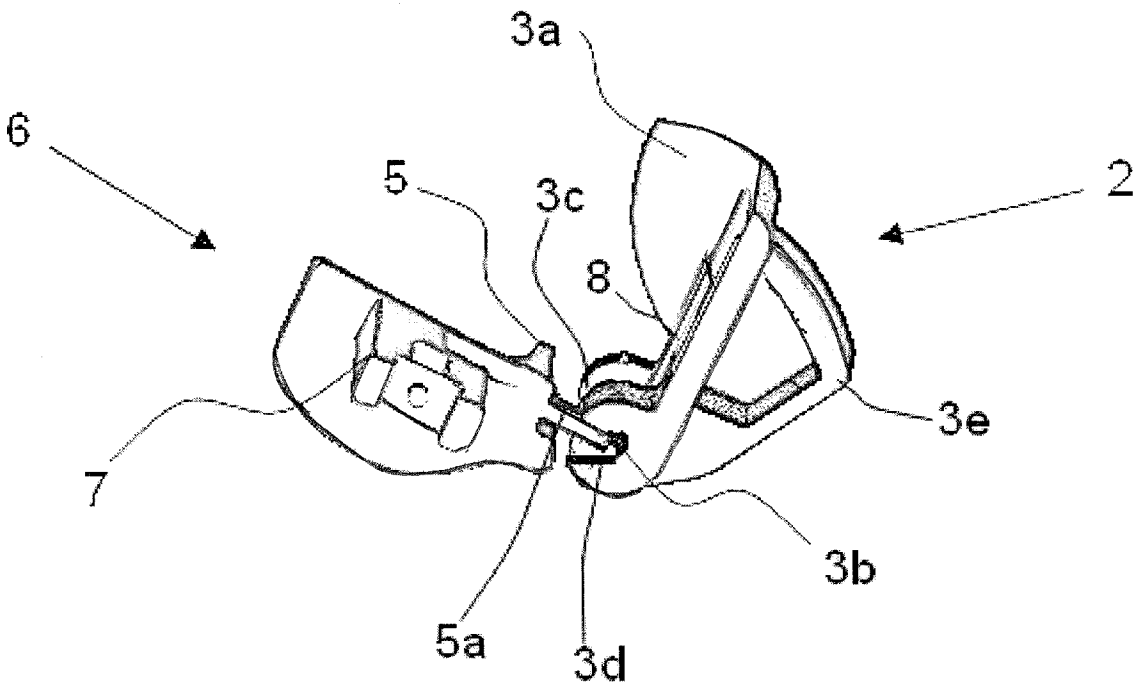
FIG. 3 is a perspective view from below of a detail of the catch system of the device in FIG. 1.
Figure 4:
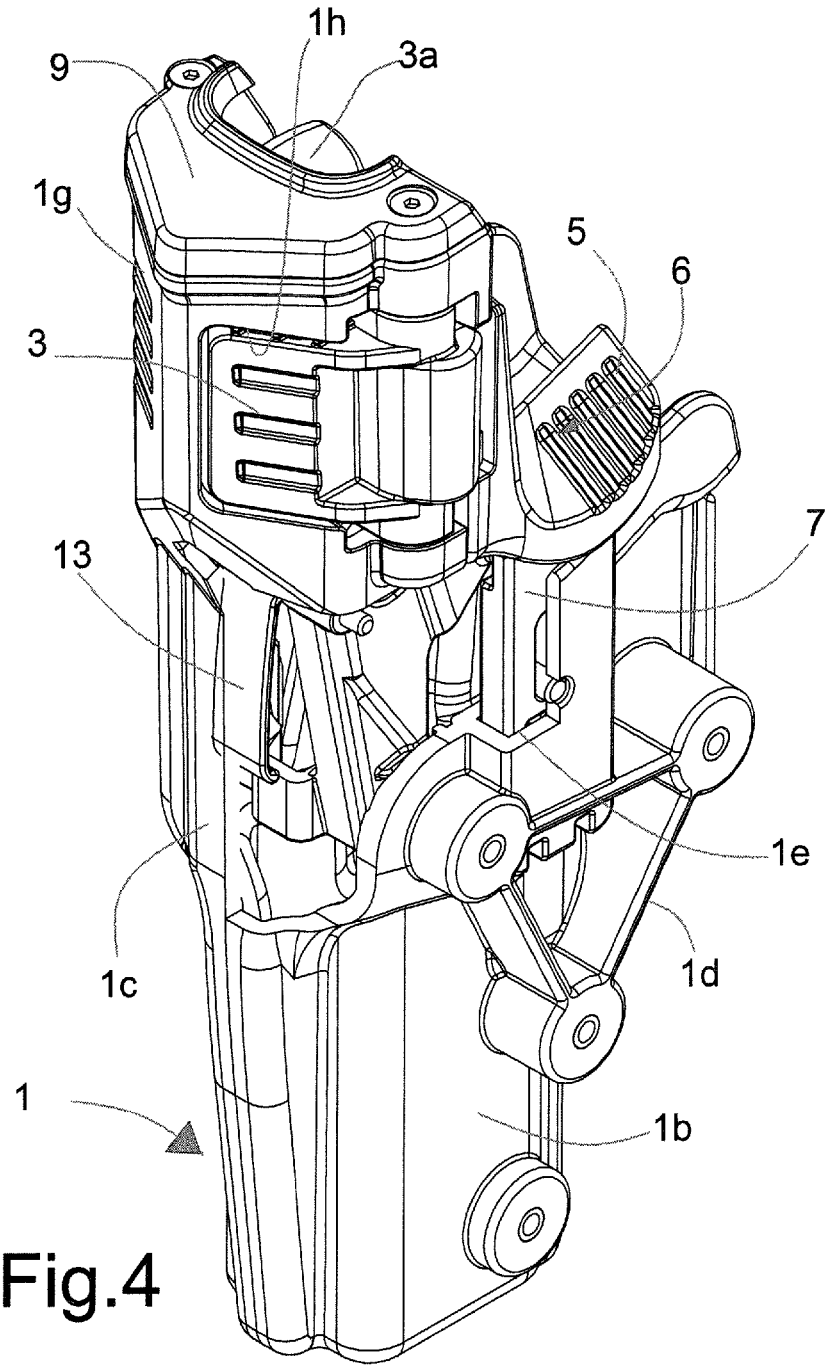
FIG. 4 is a perspective view of a holster according to the invention provided with a secondary lock for engagement with the spent casing ejection port of the handgun.

According to a preferred embodiment, the movable member of the release device consists of a push-button 6 with a top portion 5 to be contacted for actuation by the user's thumb, and a downwards slider 7 that engages within a guide pocket 1*e* provided by the above mentioned side wall. A catch 5*a* extends transversally (i.e. crosswise with respect to the longitudinal direction) from the top portion 5, for slidable engagement with a slit 3*c* (see FIG. 3) that cracks the shutter 3, running axially along the pivot accommodating seat 3*b*. The slit 3*c* ends with a step-like enlarged chamber 3*d* for snap engagement with the catch 5*a* when the latter ends its run along the slit 3*c*, actuated by pushing the push-button 6 deeply.

More precisely, a flat cantilever spring 8 is arranged between the body 1 and the shutter 3, biasing the latter to rotate outwards from the above mentioned working or locking position, to the clearance position. This rotation is however prevented by the catch 5*a* catching the slit 3*c*. Only when the catch reaches the chamber 3*d*, which is suitably enlarged with respect to the same catch, the rotation is allowed to the angular extent required, and the shutter can snap to the clearance position. In the clearance position the shutter 3 rotates sideways, remaining partially sheltered by the shell 1*g*, having a top cover plate 9, in any case without causing an increasing bulk frontally.

It is to be noticed that the arrangement of the catch 5*a* in the chamber 3*d* pursuant to the downward sliding of the push-button 6 is a stable arrangement, thereby the opening 1*a* of the holster remains clear allowing for the free extraction/insertion of the handgun. Preferably, a top face of the top portion 5 of the push-button 6 is economically shaped and has a plurality of ridges or the like, in order to increase the grip with the user's thumb, thus assisting a safe and quick pressing actuation.

A return back to the locking position can be simply obtained by directly pushing the shutter 3 manually from the outside towards the body 1, overcoming the resistance of the flat spring 8. To this purpose, the shutter 3 has a shaped outer protrusion 3*e* adapted to protrude outwards from the slanted wall portion of the shell 1*g* along the pivot 4. Once the shutter is back to the locking position, in which the shell 1*g* houses the same shutter substantially completely, the catch 5*a* of the push-button 6 corresponds and fits again with the slit 3*c*. In this position, a coil spring 16 arranged in the guide pocket 1*e* and compressed by the slider 7, makes the bush-button 6 lift back upwards, with the catch 5*a* that slides along the slit 3*c* and restores the catch action on the shutter 3 against its rotation. Further run-end stop means for the shutter can be provided both in the locking and in the release position in the form of mechanical abutments against the body 1, as obvious to the skilled person.

In a possible embodiment of the invention the above described shutter lock is associated to a second locking device that exploits the provision, in the barrel of the handgun, of a spent casing ejection port. This embodiment is specifically shown in figures from 4 to 6.

The release of the second locking device, generally indicated at 13, is driven through the same above mentioned push-button 6. In fact, the slider 7 of the button 6 provides for a recess 14 for engagement with a peg 12 at the free end of an arm 11 extending from a U-shaped frame 10 shaped so as to engage with, and lock, the ejection port of the gun.

The U-shaped frame 10 is arranged on the inside of the body 1 and rocks about a crosswise pin 15, in turn bridging across the two side walls 1*b*. In the absence of an external actuation (i.e. with the push button lifted), the fame 10 is kept in a locking position by a V-shaped flat spring 17 that, arranged between the front wall 1*c* of the body 1 and the same frame 10, keeps the latter displaced towards the inside of the body for engagement with the ejection port, preventing the gun from being extracted. The displacement of the slider 7, pursuant to the actuation of the push-button 6 by the user, causes the peg 12 to abut against an end of the recess 14; a further downwards displacement of the slider 7 brings then about a rotation of the frame 10 about the crosswise pin 15 so as to make the frame become closer to the front wall 1*c*, overcoming the hindrance of the V-shaped spring 17. A disengagement from the ejection port ensues, and in this clearance condition the handgun can be freely extracted. Once the button is released and gets back to the lifted position, the spring 17 makes the frame 10 rock back to the locking position. When the handgun is inserted back, at first it is the abutment carried out by the same gun to drive the frame 10 to the clearance position, then the insertion lets the frame elastically snap to the locking position when the gun is completely accommodated in the holster.

The second handgun locking device 13 of the holster is in correspondence with the ejection port of the handgun, where no whatsoever kind of gun carry other supplementary devices or other encumbering elements. This type of lock is then particularly advantageous because, alike the first locking device, can be made suitable to any handgun having an ejection port, including the guns provided with laser sources, tactical lights and the like, which are normally mounted in correspondence with the trigger guard.

With a holster according to the invention comprising the first locking device the handgun is kept firmly secured with a shutter 3 that pivots around a single lateral axis and swings sideways without creating any significant additional encumbrance, especially on the front side. The sideways rotation is particularly safe, because it avoids a springing of the shutter out of the frontal outline of the holster, where the rotation could possibly be hindered or prevented by external obstacles.

If also the second, automatic locking device 13 is present, a further locking action contributes to keep the gun steady and safely held by the holster. In both cases, a preferred embodiment of the holster provides for an obviously implemented alarm system integrated with the same holster and emitting audible sounds or vibrations in the very moment when the locking occurs. In this way the user is made sure that the gun is safely accommodated in the holster and secured thereto; at that point, only the actuation of the push-button 6 will permit to remove the gun from its position.

Advantageously, the holster according to the invention allows therefore the release of the locking system by actuating a single push-button with the thumb of the hand that grips the gun. In particular, the actuation is carried out with an instinctive and natural downwards movement of the thumb, compared with known actuations requiring more unnatural and two step movements in different directions. The position of the push-button is also comfortable and ergonomic, allowing for a release of the lock and at the same a complete and firm grip on the stock of the gun, without the need for readjusting or adapting the gripping hand on the gun after the release actuation. Release and extraction of the gun occur then with a single continuous and fluid motion, that simplifies and makes quicker the extraction of the gun without however jeopardizing the safety of the locking system.

Finally, given that the first locking device locks the gun through a projection of the shutter in correspondence with the stock and that in normal conditions does not contact the same gun, the holster is suitable for use with any kind of handguns, including handguns with laser targeting sights, tactical lights and similar accessories mounted under the trigger guard.

The spatial references "top", "bottom" "up", "down", "front", "side" and the like used in the present description are obviously referred to a use arrangement of the holster when worn on a user's lap.

Variants and/or modifications can be brought to the holster support according to the present invention, without departing from the scope of the invention itself as defined by the following claims.

The invention claimed is:

1. A safety holster for handguns comprising:

a hollow body defined by two side walls joined together by a front wall and a rear wall, and adapted to receive said handgun through a top opening, said body defining a longitudinal direction substantially corresponding to the axis of the barrel of the handgun when housed in the body;

a first locking device comprising locking means pivotally mounted on at least one of said side walls so that it is adapted to between two angularly spaced positions, a locking position where said locking means partially shuts from above the holster opening preventing the extraction of the handgun, and a release position in which the locking means clear said holster opening;

elastic means for biasing the rotation of said locking means from said locking position to said release position; and a release device mounted in one of said side walls and comprising a thumb-actuated displaceable member for catching said locking means in said locking position and is slidable in the longitudinal direction, the actuation of said displaceable member in the longitudinal direction releasing said locking means allowing rotation from said locking position to said release position, wherein said locking means comprise a shutter pivotally connected to one of said side walls so as to swing about an axis (X) running along said longitudinal direction.

2. The safety holster according to claim 1, wherein said shutter in said release position projects sideways from said side wall.

3. The safety holster according to claim 1, wherein said shutter comprises a top projection adapted to partially shut said opening in said locking position by passing through a window formed in said body.

4. The safety holster according to claim 3, wherein said window is formed in a bridging shell joining said side walls at the top and bulging from said front wall, said bridging shell housing said shutter in said locking position and partially housing said shutter also in said release position.

5. The safety holster according to claim 4, wherein said shell comprises two slanting wall portions in a V-shaped arrangement, said window being formed in one of said slanting portions.

6. The holster according to claim 4, wherein said shell has a top cover plate for at least partially sheltering said shutter in said release position.

7. The holster according to claim 4, wherein said shutter comprises a shaped outer protrusion adapted to protrude outwards from said shell in said release position.

8. The holster according to claim 1, wherein said elastic means comprise a flat cantilever spring arranged between the body and the shutter.

9. The holster according to claim 1, wherein said displaceable actuation member comprises a push-button arranged in the same side wall of said shutter so as to be slidable in the longitudinal direction following a pressure of the user's thumb, said button comprising a catch slidably engaging with a slit formed in said shutter for preventing the rotation of the same away from said locking position, said slit comprising an end enlarged step-like chamber that when reached by said catch lets said shutter to rotate to said release position biased by said elastic means, the downwards actuation displacement of said button being hindered by a spring.

10. The holster according to claim 9, further comprising a second locking device comprising a U-shaped frame adapted to engage with an ejection port of said handgun, said frame being arranged on the inside of the body and rocking about a crosswise axis bridging across the two side walls between a locking position and a release position, said push-button engaging with said frame to rotate it from the locking position to the release position further to the same downward actuation displacement releasing said first locking device, second elastic means being arranged between the body and the frame for biasing the latter in the locking position.

11. The holster according to claim 10, wherein said button provides for a recess for engagement with a peg at the free end of an arm extending from said frame, whereby the displacement of the push-button by the user causes the peg to abut against an end of the recess and brings then about the rotation of the frame to the release position overcoming the hindrance of said second elastic means.

12. The safety holster according to claim 9, wherein said push-button has a top portion from which said catch extends and shaped ergonomically to be contacted for actuation by the user's thumb, and a downwards slider that engages within a guide pocket provided by said side wall.

13. The safety holster according to claim 1, further comprising a device that emits sound or vibration when said shutter reaches said locking position.

14. The safety holster according to claim 10, further comprising a device that emits sound or vibration when said shutter reaches said locking position and when said second locking device reaches said locking position.

* * * * *